US006060988A

United States Patent [19]

Copeland et al.

[11] Patent Number: 6,060,988

[45] Date of Patent: May 9, 2000

[54] EAS MARKER DEACTIVATION DEVICE HAVING CORE-WOUND ENERGIZED COILS

[75] Inventors: Richard L. Copeland, Boca Raton, Fla.; Kevin R. Coffey, Fremont, Calif.

[73] Assignee: Sensormatic Electronics Corporation, Boca Raton, Fla.

[21] Appl. No.: 09/016,175

[22] Filed: Jan. 30, 1998

Related U.S. Application Data

[63] Continuation-in-part of application No. 08/794,012, Feb. 3, 1997, Pat. No. 5,867,101.

[51] Int. Cl.[7] ..... G08B 13/14

[52] U.S. Cl. ..... 340/572.1; 340/572.3; 340/572.7; 340/551; 361/149

[58] Field of Search ..... 340/572.1, 572.2, 340/572.7, 551, 572.3; 335/284; 361/149, 267; 343/742

[56] References Cited

U.S. PATENT DOCUMENTS

| | | | |
|---|---|---|---|
| 3,665,449 | 5/1972 | Elder et al. | 340/572.3 |
| 3,781,661 | 12/1973 | Trikilis | 340/572.3 |
| 4,300,183 | 11/1981 | Richardson | 340/572.1 |
| 4,423,460 | 12/1983 | Jackson et al. | 361/149 |
| 4,510,489 | 4/1985 | Anderson, III et al. | 340/572 |
| 4,633,250 | 12/1986 | Anderson, III et al. | 342/27 |
| 5,049,856 | 9/1991 | Crossfield | 340/551 |
| 5,051,726 | 9/1991 | Copeland et al. | 340/572 |
| 5,061,941 | 10/1991 | Lizzi et al. | 343/742 |
| 5,142,292 | 8/1992 | Chang | 343/742 |
| 5,210,524 | 5/1993 | Schwarz et al. | 340/551 |
| 5,341,125 | 8/1994 | Plonsky et al. | 340/572 |
| 5,345,222 | 9/1994 | Davies et al. | 340/572.7 |
| 5,459,451 | 10/1995 | Crossfield et al. | 340/572.7 |
| 5,469,142 | 11/1995 | Bergman et al. | 340/572 |
| 5,493,275 | 2/1996 | Easter | 340/572 |
| 5,625,339 | 4/1997 | Zarembo et al. | 340/551 |
| 5,805,065 | 9/1998 | Schwarz et al. | 340/572.3 |

*Primary Examiner*—Daniel J. Wu
*Assistant Examiner*—John Tweel, Jr.
*Attorney, Agent, or Firm*—Robin, Blecker & Daley

[57] ABSTRACT

A device for deactivating a magnetomechanical EAS marker includes a coil and circuitry for energizing the coil to generate an alternating magnetic field. The coil is wound around a magnetic core. The core may be cruciform with four arms, on each of which a respective coil is provided. Alternatively, the core may be generally square and planar, with two coils wound around the core in different respective directions.

35 Claims, 7 Drawing Sheets

EAS MARKER DEACTIVATION DEVICE HAVING CORE-WOUND ENERGIZED COILS

CROSS REFERENCE TO RELATED APPLICATION

This application is a continuation-in-part of application Ser. No. 08/794,012, filed Feb. 3, 1997, now U.S. Pat. No. 5,867,101.

FIELD OF THE INVENTION

This invention relates generally to electronic article surveillance (EAS) and pertains more particularly to so-called "deactivators" for rendering EAS markers inactive.

BACKGROUND OF THE INVENTION

It has been customary in the electronic article surveillance industry to apply EAS markers to articles of merchandise. Detection equipment is positioned at store exits to detect attempts to remove active markers from the store premises, and to generate an alarm in such cases. When a customer presents an article for payment at a checkout counter, a checkout clerk deactivates the marker by using a deactivation device provided to deactivate the marker.

Known deactivation devices include one or more coils that are energizable to generate a magnetic field of sufficient amplitude to render the marker inactive. One well known type of marker (disclosed in U.S. Pat. No. 4,510,489) is known as a "magnetomechanical" marker. Magnetomechanical markers include an active element and a bias element. When the bias element is magnetized, the resulting bias magnetic field applied to the active element causes the active element to be mechanically resonant at a predetermined frequency upon exposure to an interrogation signal which alternates at the predetermined frequency and is generated by detecting apparatus, and the resonance of the marker is detected by the detecting apparatus. Typically, magnetomechanical markers are deactivated by exposing the bias element to an alternating magnetic field of sufficient magnitude to degauss the bias element. After the bias element is degaussed, the marker's resonant frequency is substantially shifted from the predetermined frequency, and the marker's response to the interrogation signal is at too low an amplitude for detection by the detecting apparatus.

In addition to conventional deactivators utilizing coils excited with an alternating signal, the assignee of the present application has developed additional deactivation devices having advantageous operating characteristics. One of these devices is disclosed in co-pending patent application Ser. No. 08/794,012, filed Feb. 3, 1997 and entitled, "Multi-Phase Mode Multiple Coil Distance Deactivator for Magnetomechanical EAS Marker". The '012 application has common inventors with the present application and discloses a number of embodiments of devices for deactivating magnetomechanical EAS markers. A main point of the disclosure of the '012 application is that the deactivators disclosed therein provide substantial alternating magnetic fields oriented in three mutually orthogonal directions to provide reliable deactivation of markers regardless of the orientation of the markers when presented for deactivation. The deactivation devices of the '012 application also provide for reliable deactivation of markers even when the markers are presented for deactivation at some distance (a matter of inches) from the deactivation device. In one embodiment disclosed in the '012 application, four planar rectangular coils are arranged in a two-by-two array in proximity to each other in a common plane, and the deactivation device is repeatedly switched between two modes of operation. In the first mode of operation, the two coils along one diagonal of the two-by-two array are simultaneously driven in phase opposition to each other, while the other two coils are not driven. In the second mode, the latter two coils are driven in phase opposition to each other, and the first two coils are not driven.

Another co-pending patent application is Ser. No. 08/801,489, filed Feb. 18, 1997, and entitled, "Apparatus for Deactivating Magnetomechanical EAS Markers Affixed to Magnetic Recording Medium Products" and having the same inventors as the present application. In the '489 application there are disclosed deactivation devices which employ planar arrays of "pancake" coils in which field gradients are minimized and generally uniform field levels are provided in proximity to the deactivation device, so that magnetomechanical EAS markers may be reliably deactivated without adversely affecting magnetic medium products to which the markers are affixed.

Although the above-referenced '012 and '489 applications are believed to represent advances over conventional deactivators, the inventors have recognized additional opportunities for improvements in marker deactivation equipment.

OBJECTS AND SUMMARY OF THE INVENTION

It is a primary object of the present invention to provide improved devices for deactivating magnetomechanical EAS markers.

More particular objects of the invention are to provide deactivation devices that operate at lower power levels than conventional devices, and can be manufactured at lower cost.

It is another object of the invention to provide a deactivation device that operates substantially without sensitivity to the orientation of markers presented for deactivation.

According to an aspect of the invention, a device provided for deactivating a magnetomechanical EAS marker, and including a coil and circuitry for energizing the coil to generate an alternating magnetic field, is improved by including a magnetic core around which the coil is wound. The core may be formed of powdered metal, cast iron, silicon steel or carbon steel, for example. In one embodiment of the invention, the core is cruciform and has four arms, with a respective coil positioned on each of the arms. The energizing circuitry may include circuitry for energizing, only during a first sequence of time intervals, the respective coils on an opposed pair of the four arms and for energizing, only during a second sequence of time intervals interleaved with the first sequence of time intervals, the respective coils on the other opposed pair of the four arms.

According to another embodiment of the invention, the magnetic core is generally square and planar and has two coils wound thereon, the two coils having respective axes that are orthogonal to each other.

According to a further aspect of the invention, there is provided a method of deactivating a magnetomechanical EAS marker, including the steps of providing a coil wound around a magnetic core, energizing the coil to generate an alternating magnetic field, and moving the EAS marker through the alternating magnetic field to degauss a control element of the marker.

A deactivation device provided in accordance with the invention, utilizing a coil wound around a magnetic core to generate a deactivation field, can be constructed so as to be more compact than devices which do not employ a magnetic core, relative to the spatial extent of the deactivation field. Also, the quantity of copper wire required for the coil can be reduced relative to a device in which no core is used, so that the cost of the device is reduced. In addition, for a given field amplitude, the level of power required to drive the coil is less in the deactivation device provided according to the present invention.

The foregoing, and other objects, features and advantages of the invention, will be further understood from the following detailed description of preferred embodiments and from the drawings, wherein like reference numerals identify like components and parts throughout.

DESCRIPTION OF PREFERRED EMBODIMENTS

Figure 1:
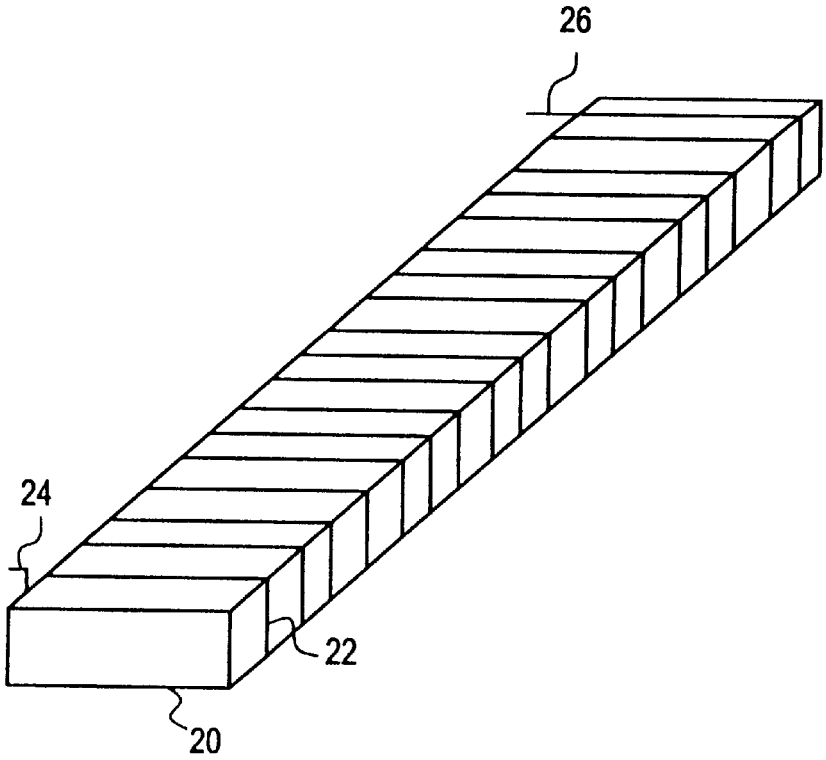
FIG. 1 is an isometric view of a magnetic core, with a coil wound thereon, provided for use in an embodiment of the present invention.

FIG. 1 shows a magnetic core 20 suitable for use in an embodiment of the invention. The magnetic core is in the form of a rectangular prism and may, for example, have a length of 8 inches, a width of 3.5 inches, and a thickness of 1 inch. The core 20 may be formed of a relatively inexpensive ferromagnetic material, such as powdered metal, cast iron, silicon steel or carbon steel.

A coil 22 is shown wound around the magnetic core 20. For purposes of illustration, the coil winding is shown as being rather sparse. In fact, in a practical embodiment, the number of turns may be in the hundreds. The axis of winding of the coil 22 coincides with the longitudinal axis of the core 20. The coil 22 has leads 24 and 26 by which the coil 22 may be connected to driving circuitry (not shown). Of course, a suitable housing (not shown) may be provided around the core 20 and coil 22.

When the coil 22 is energized, the core 20 forms a magnetic dipole having a length corresponding to the length of the core. By contrast, if it were desired to provide a magnetic dipole of equal length, utilizing a side-by-side arrangement of planar coils in accordance with the teachings of the above-referenced '012 application, a much larger "footprint" for the deactivation device would be required. To provide a concrete example, the magnetic core as described just above, which provides an 8-inch dipole, has a footprint of about 28 square inches. To provide the same length dipole utilizing side-by-side planar square coils (arranged in a common plane) would require two 8-inch square coils having a combined footprint of 128 square inches.

Figure 2:
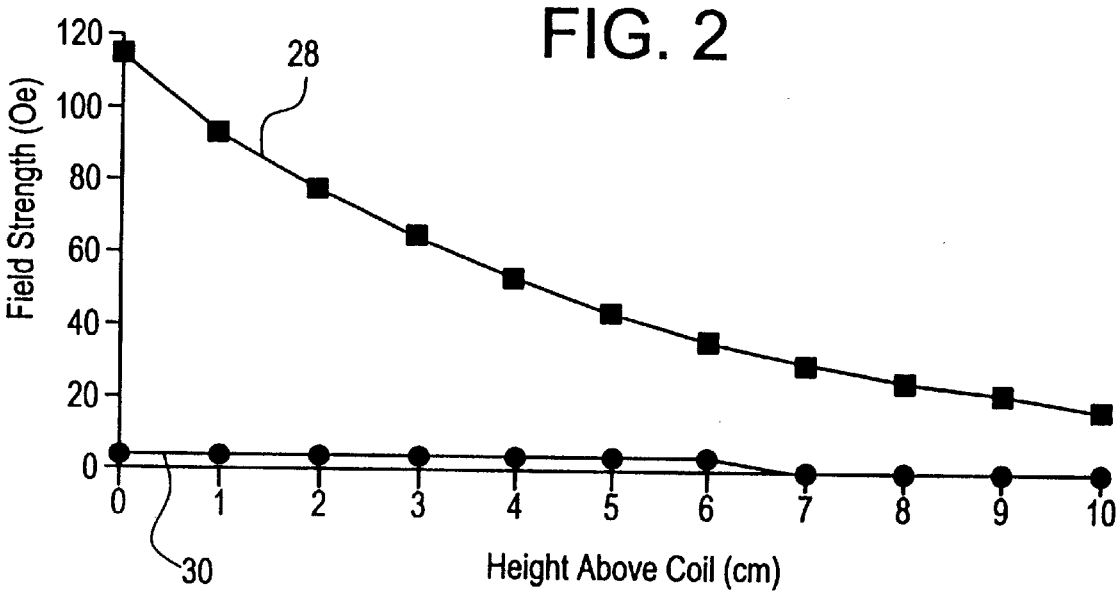
FIG. 2 graphically illustrates differences in the strength of magnetic fields provided by an energized coil with and without a core around which the coil is wound.

FIG. 2 graphically illustrates how the presence of the magnetic core effectively amplifies the level of the magnetic field generated when the coil is energized. For the purpose of the measurements shown in FIG. 2, the coil 22 was formed with 493 turns around a core having dimensions as recited above, and was excited with a 5 amp DC current. (Although DC driving signals were used to obtain the measurements reported herein, it will be recognized that in practical applications of the deactivation devices, AC driving signals would be employed to generate an alternating magnetic deactivation field.) Readings of field strength in the direction parallel to the length of the core were taken at various distances above the coil. The curve 28 indicates readings taken when the core 20 was present, and the curve 30 indicates readings taken when the core was removed.

The effective permeability of the core 20, and consequently the effective amplification of the magnetic field, varies according to the distance above the coil at which the field is measured. As seen from FIG. 2, the field at the coil itself is close to 120 Oe when the core is present, and is only around 4 Oe without the core, so that the effective magnetic amplification of the field is about 30 immediately above the coil. On the other hand, at a height of 10 cm above the coil 22, the field strength when the core is present is just under 10 Oe and the effective amplification of the field is about 10 at this height. As can be seen from FIG. 2, whether the field is measured at the coil 22 or a number of centimeters above the coil 22, the presence of the core 20 greatly amplifies the level of the magnetic field that is generated.

It will be recognized that the provision of the magnetic core allows a much stronger deactivation field to be generated for a given level of the driving signal. Conversely, using the magnetic core permits a given level of deactivation field to be maintained at a given distance above the coil at a substantially lower level of driving signal than if an air-core is used.

Figure 3:
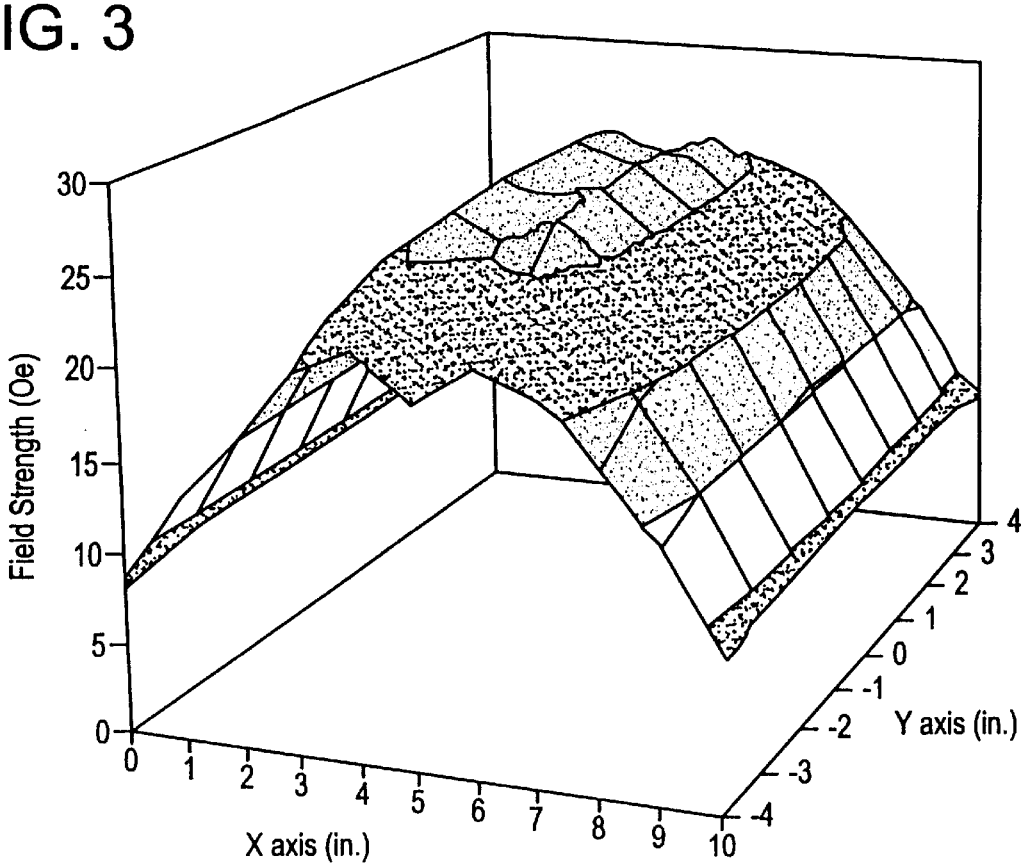
FIG. 3 is a surface plot of the strength of the magnetic field generated by the coil-wound core of FIG. 1, measured in a horizontal direction parallel to the length of the core.
Figure 4:
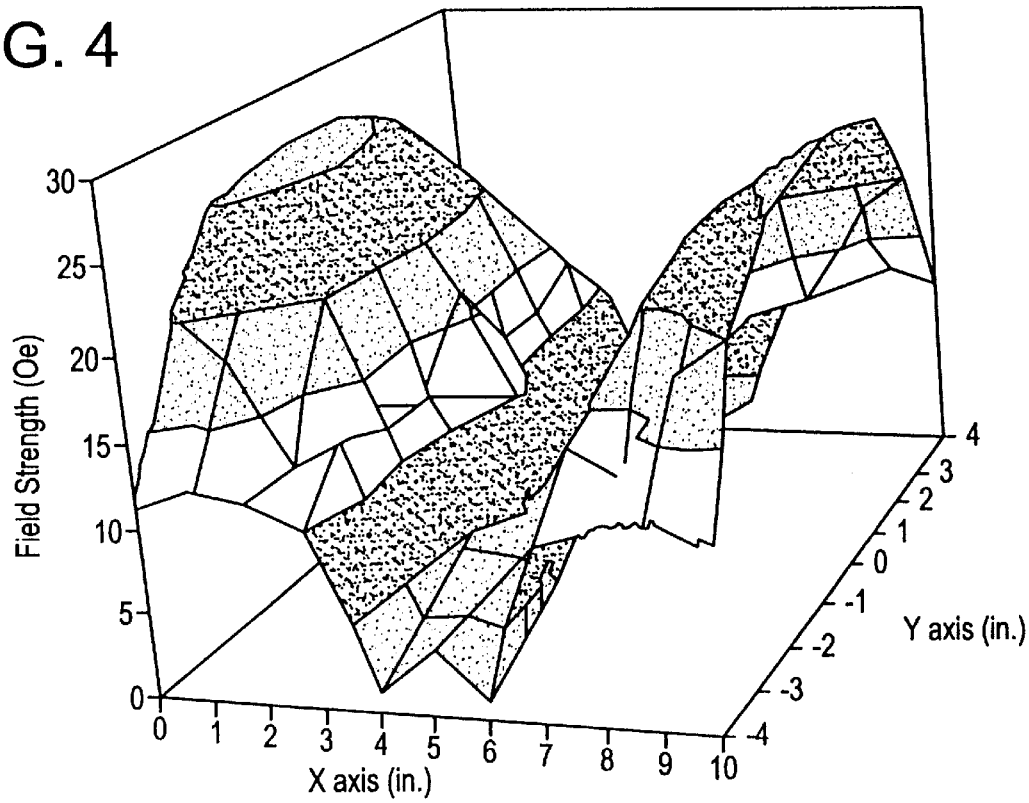
FIG. 4 is a surface plot of the strength of the field generated by the core of FIG. 1, measured in a vertical direction.

The pattern of the field generated by the core-wound coil arrangement of FIG. 1 is shown in more detail in FIGS. 3 and 4. For the plots shown in FIGS. 3 and 4, the core geometry was 10 inches long by 3 inches wide by 1 inch thick. The coil was wound with 1200 turns and energized with 5 amps DC. The field levels plotted in FIGS. 3 and 4 were taken at a constant height of about 6.5 inches above the coil, at various locations in a horizontal plane. For the coordinate system referred to in FIGS. 3 and 4, the X and Y directions were taken to be horizontal, with the X axis parallel to the length of the core and the Y axis perpendicular to the X axis. The X-Y origin was taken to be at one end of the core and in a central position relative to the width of the core. The data plotted in FIG. 3 indicates the strength of the magnetic field in an orientation parallel to the length of the core (i.e., in the X-axis direction), and the data plotted in FIG. 4 indicates the effective magnetic field in the vertical ("Z-axis") direction.

From FIG. 3, it will be seen that the lengthwise field is strongest at a central position between the ends of the core, whereas the vertical field is strongest at the ends of the core and is at a very low level between the ends of the core.

Figure 5:
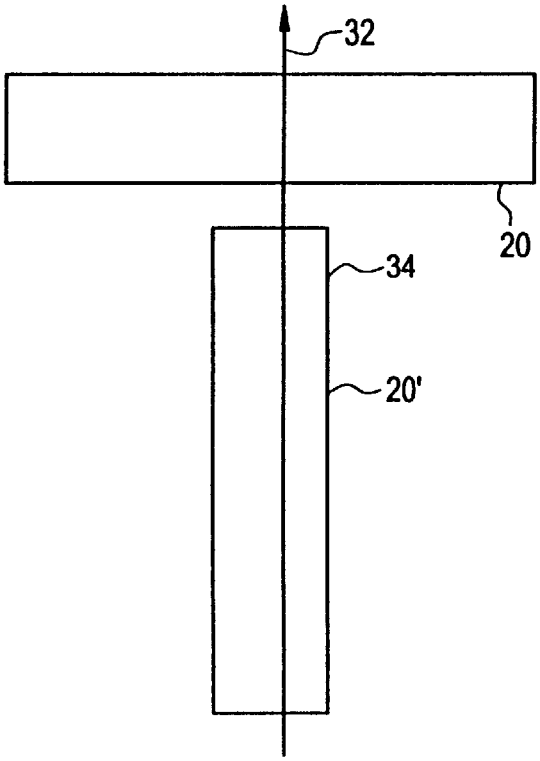
FIG. 5 schematically presents a plan view of a T-configuration formed by two cores used in an alternative embodiment of the present invention.

The core-wound coil arrangement of FIG. 1 produces little magnetic field in the horizontal direction transverse to the length of the core, and therefore would not be very effective in deactivating magnetomechanical EAS markers presented with the length of the marker horizontal and transverse to the core length. To overcome this disadvantage, a deactivation device may be formed having two coil-wound cores arranged in a T-configuration, as illustrated in FIG. 5. As seen from FIG. 5, cores 20 and 20' are arranged in a plane and oriented in respective perpendicular directions with an end 34 of core 20' adjacent a center portion of core 20. (The coil windings, driving circuitry and electrical connections are omitted from FIG. 5 to simplify the drawing.)

A magnetomechanical marker swept close to the plane of the cores 20 and 20', along the locus indicated by arrow 32, would be assured of being exposed to a substantial magnetic field along the length of the marker, regardless of the orientation of the marker. Specifically, the marker would be exposed to the horizontal field generated by the core 20' parallel to the length of the core 20', and would also be exposed to the vertical field generated at the end 34 of core 20'. Finally, the marker would be exposed to the horizontal field parallel to the length of core 10 and generated by the core 20. The deactivation device schematically illustrated in FIG. 5 can therefore be referred to as "omni-directional" since the effectiveness of the deactivation device is not sensitive to the orientation of the marker.

Figure 6:
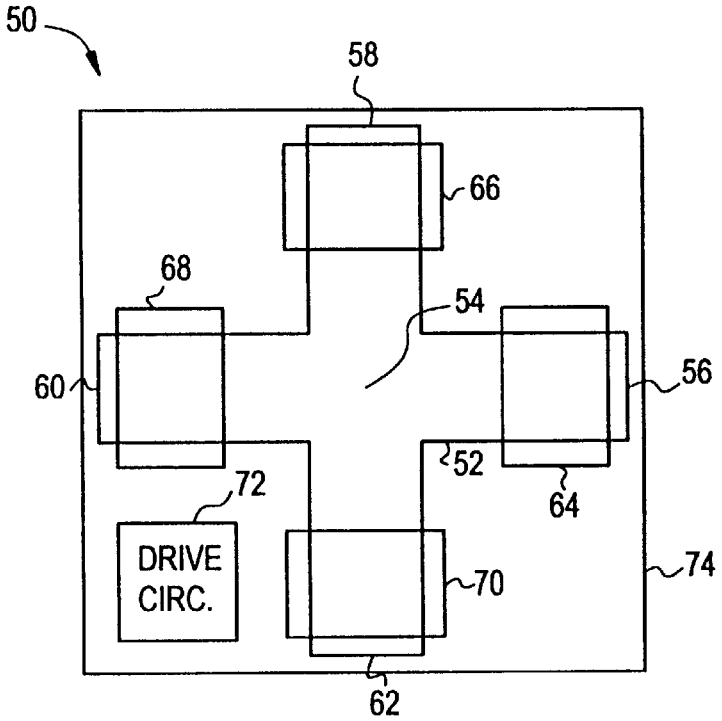
FIG. 6 is a somewhat schematic plan view of a marker deactivation device according to an embodiment of the present invention, including a cruciform magnetic core.

A more space-efficient omni-directional deactivator provided in accordance with the invention is shown in a schematic plan view in FIG. 6. The deactivation device of FIG. 6 is generally indicated by reference numeral 50, and includes a cruciform magnetic core 52. The core 52 has a central portion 54, from which arms 56, 58, 60 and 62 radiate in a common plane at 90° intervals. In a preferred embodiment, all of the arms are of equal length, the core measures about 10 inches from the tip of one arm to the tip of an opposed arm (e.g., from the tip of arm 56 to the tip of arm 60), and each arm has a width of about 3 inches and a height of about one-half inch. Consequently, the central portion 54 can be considered to form a three-inch square in the plane of the core 52.

Wire coils 64, 66, 68 and 70 are respectively wound around core arms 56, 58, 60 and 62. In a preferred manner of manufacturing the deactivator 50, the coils 64–70 are pre-wound and then slipped onto the ends of the arms of core 52. It will be observed that, when positioned on core 52 as shown in FIG. 6, coils 64 and 68 have a common axis of winding, and coils 66 and 70 have a common axis of winding perpendicular to the axis of coils 64 and 68.

Also included in the deactivation device 50 is driving circuitry 72. (Connections between the driving circuitry 72 and the coils 64, 66, 68 and 70 are omitted to simplify the drawing.) All of the previously-mentioned components of the deactivator 50 are contained within a housing 74, which may take the form of a flat-topped low-profile plastic casing of the sort employed in conventional "deactivation pad" devices.

Figure 7:
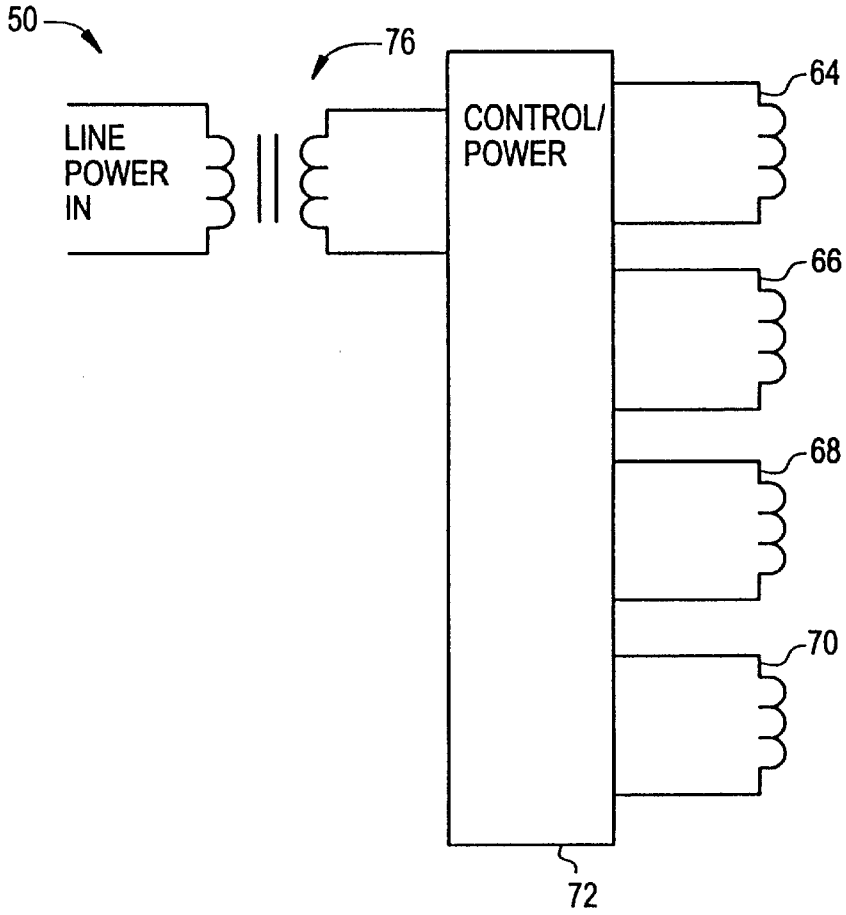
FIG. 7 is a partially schematic and partially block circuit representation of the deactivation device of FIG. 6.

FIG. 7 illustrates in schematic form the electrical components of the deactivator 50, including the coils 64, 66, 68 and 70, which are connected to line power via an isolation transformer 76 and the aforementioned drive circuitry 72.

In operation, the driving circuitry 72 preferably functions so that the deactivation device 50 is switched, rapidly and repeatedly, between two operating modes. In the first operating mode, coils 64 and 68 are energized with an alternating signal simultaneously and in phase to form an alternating dipole corresponding to arms 60 and 56. Coils 66 and 70 are not driven in the first mode. In the second mode, coils 66 and 70 are driven with the alternating signal simultaneously and in phase with each other to form an alternating dipole corresponding to arms 58 and 62. Coils 64 and 68 are not driven in the second mode.

Preferably, each mode occurs several times during each second. It will be understood that the times when the first mode is in effect correspond to a first sequence of time intervals, and the times when the second mode is in effect correspond to a second sequence of time intervals interleaved with the first sequence of time intervals. The alternating signal used to drive the coils may, for example, be at a standard power line frequency such as 60 Hz or 50 Hz, or may be in the range of a few hundred hertz.

During the first mode of operation, a strong horizontal magnetic field is generated in the direction parallel to arms 60 and 56. A significant vertical field is also generated at the ends of arms 60 and 56. Moreover, during the second mode, a strong horizontal field is generated in the direction parallel to arms 58 and 62, and vertical fields are generated at the ends of arms 58 and 62. Consequently, a magnetomechanical marker swept horizontally in proximity to the top of the housing 74 of the device 50 will be exposed to a strong magnetic field along the length of the marker, substantially without regard to the direction in which the marker is swept or the direction of orientation of the length of the marker.

Figure 8:
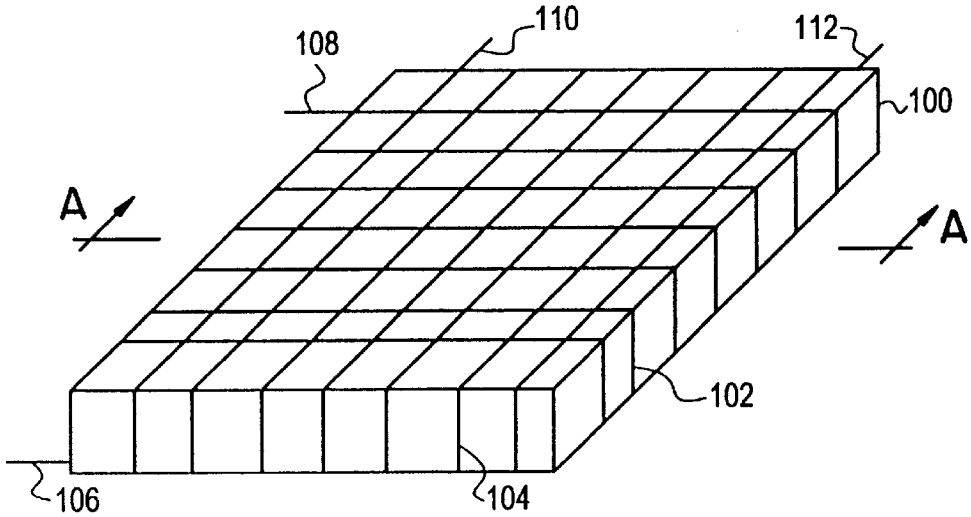
FIG. 8 is an isometric view of a square, planar magnetic core, on which two coils are wound in accordance with another embodiment of the invention.

FIG. 8 is an isometric view of another core and winding configuration that may be used in accordance with the invention in a marker deactivation device. The core 100 shown in FIG. 8 is generally square and planar and would preferably be housed in a deactivation device in a horizontal orientation. A first coil 102 is wound around the core 100 with an axis of winding of the coil 102 oriented horizontally and parallel to the two sides of the core 100 which are crossed by the coil 102. A second coil 104 is also wound around the core 100, with an axis of winding of the coil 104 oriented horizontally and perpendicular to the axis of winding of coil 102. Coil 102 has leads 106 and 108 for connecting the coil 102 to driving circuitry (not shown). Similarly, coil 104 has leads 110 and 112 for connecting the coil 104 to driving circuitry. The deactivation device (not shown) in which the core 100 is incorporated is preferably switched repeatedly and rapidly between two operating modes. In the first mode, the coil 102 is driven and the coil 104 is not driven, so that a dipole is formed in a direction which corresponds to the axis of winding of the coil 102. In the second mode, the coil 104 is energized and the coil 102 is not energized, to form a dipole in a direction which corresponds to the axis of winding of the coil 104.

According to one manner of manufacturing this embodiment of the deactivator, one of the two coils is wound first around the core 100, and then the second coil is wound around the core and over the first coil.

Like the deactivation device 50 of FIG. 6, a deactivation device employing the core 100 of FIG. 8 generates a substantial magnetic field in a respective one of two orthogonal horizontal directions during each of the two operating modes. The dipoles formed using the core 100 are substantially wider than those formed using the cruciform core 52 of FIG. 6, so that the resulting magnetic field has a substantially lower gradient and is more suitable for use with magnetic medium products such as pre-recorded tape cassettes.

In the embodiment shown in FIG. 8, a core having a planar and substantially square shape was utilized. However, it is also contemplated to utilize a planar core that is rectangular but departs to some degree from square. To the extent that a rectangular core is non-square, the gradient of the field provided in one of the horizontal directions parallel to the sides of the core would tend to be increased. As a result, a marker presented for deactivation and oriented in the direction of the increased gradient would, when swept over the deactivation device, tend to experience a relatively rapid AC ring-down signal. If the effective ring-down is too rapid, reliable deactivation cannot be assured. The square-shaped core shown in FIG. 8 is therefore preferred since it provides a relatively orientation-insensitive deactivation field.

Figure 9:
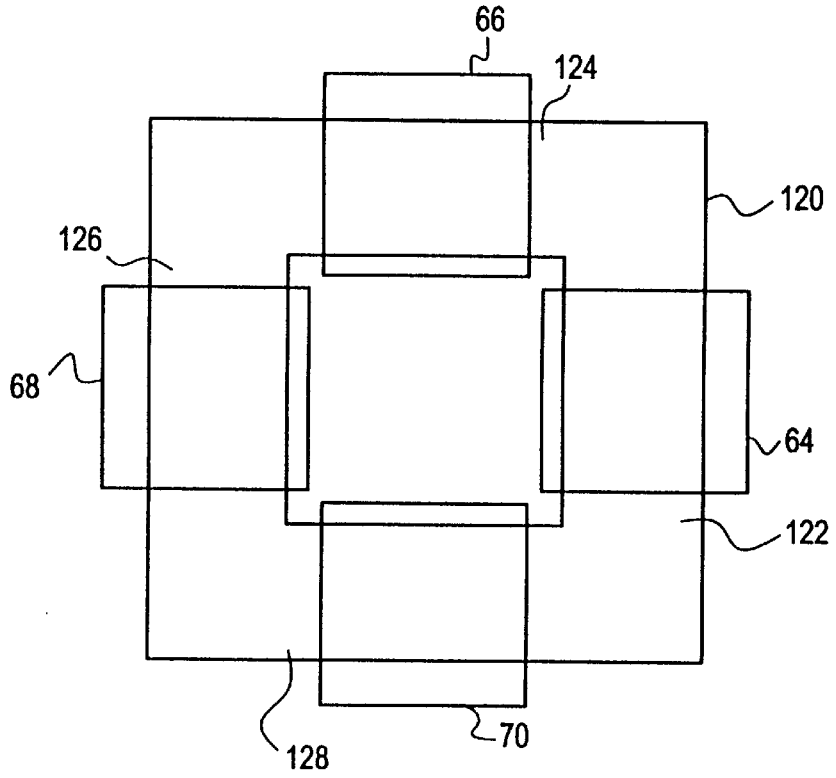
FIG. 9 is a schematic plan view of a "picture frame" magnetic core employed in a further embodiment of the invention.

FIG. 9 illustrates another core configuration that may be used in place of the cruciform core 52 in the deactivation device 50 of FIG. 6. The core 120 is shown in plan view in FIG. 9 and is generally planar with a hollow square or "picture frame" configuration. The core 120 has a respective one of the coils 64, 66, 68 and 70 wound around each of its four sides 122, 124, 126 and 128. It will be observed that coils 64 and 68 have respective axes of winding that are parallel to each other, and coils 66 and 70 have respective axes of winding that are parallel to each other and perpendicular to the axes of coils 64 and 68.

As before, the modified deactivation device is operated in two alternated modes, in each of which an opposed pair of the coils would be energized, so that mutually orthogonal horizontal dipoles would be formed, respectively, in the two modes. The phases of excitation of the coils should be such that no current circulates in the core 120. When the coils 68 and 64 are driven in the first mode, a dipole is formed in a horizontal direction parallel to sides 126 and 122 of the core 120. When the coils 66 and 70 are driven in the second mode, a dipole is formed in a horizontal direction parallel to sides 124 and 128 of the core 120. An advantage provided by the core configuration of FIG. 8, relative to those of FIGS. 1, 5, 6 and 9, is that the magnetic field formed using the core 120 has lower gradients than the fields produced using the configurations of FIGS. 1, 5, 6 and 9. That is, the ratio of the magnetic field level at the top surface of the deactivation device to the level at some distance (say 5 inches) above the top surface is minimized. Consequently, such a device is well suited for use with markers applied to magnetic media products, such as prerecorded video or audio tapes.

It is contemplated to modify the embodiment of FIG. 8 by winding the coils in a way that aids in minimizing the field gradient. For example, the coil may be wound in two or more layers, with the innermost layer having the largest number of turns and each other layer having fewer turns relative to the immediately inward layer.

Figure 9A:
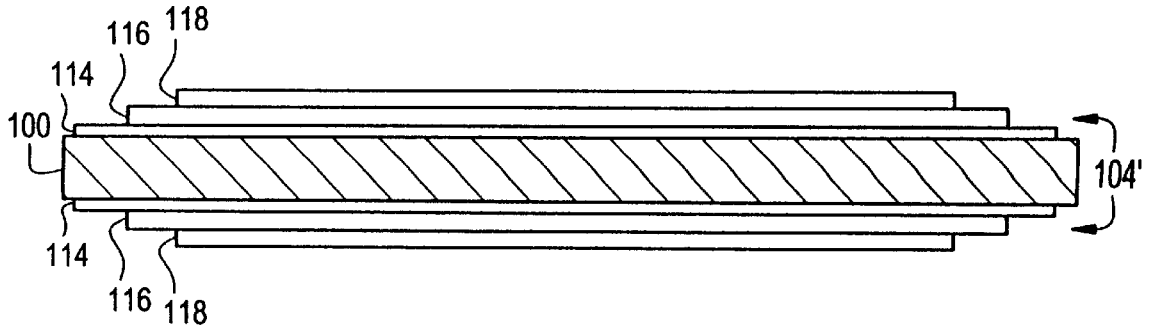
FIG. 9A is a somewhat schematic cross-sectional view, taken at line A—A in FIG. 8, illustrating a modification of the embodiment of FIG. 8.

FIG. 9A schematically illustrates this modified embodiment. In FIG. 9A, only the coil 104' is shown, the coil corresponding to coil 102 of FIG. 8 having been omitted to simplify the drawing. The coil 104' is wound in layers 114, 116, 118 of which layer 114 is innermost (nearest to core 100) and is formed of the most turns. Layer 116 is positioned intermediate between layers 114 and 118, and has fewer turns than layer 114 and more than layer 118. Layer 118 is outermost of the three layers (farthest from core 100), and has fewer turns than either of the other two layers. (To simplify the drawing, the individual turns making up the layers 114, 116, 118 are not shown).

Details of the circuitry employed to drive coils in two alternated modes will now be described, with reference to FIGS. 10 and 11. The symbol 130 in FIG. 10 indicates an AC power signal provided to the circuitry. The drive circuitry 72 includes a microprocessor 132, which controls switches 134 and 136 through control and interface circuitry 138. The input power is selectively supplied to the coil pair 64 and 68 via the switch 134. A resonance capacitor 140 is connected between the switch 134 and the coils 64, 68 to form a resonant LC circuit with coils 64, 68. A resonance capacitor 142 is connected between the switch 136 and coils 66, 70 to form a resonant LC circuit with the coils 66, 70.

A zero crossing detector circuit 144 detects zero crossing points in the input power signal and provides corresponding detection signals to the microprocessor 132. One or more optical sensors 146 positioned on or adjacent to the housing 74 (FIG. 6) of the deactivation device detect motion at the deactivation device and provide corresponding detection signals to the microprocessor 132 through an interface circuit 148. The number of optical sensors 146 provided is preferably two, with each of the two sensors 146 located in a central position on a respective one of opposite top side edges of the deactivation device housing 74. Use of only one optical sensor is also contemplated, as is use of three, four or more optical sensors. If four sensors are used, the same may be placed so that one sensor is provided at a central position on each of the four side edges of the top of the housing 74 (FIG. 6).

Figure 10:
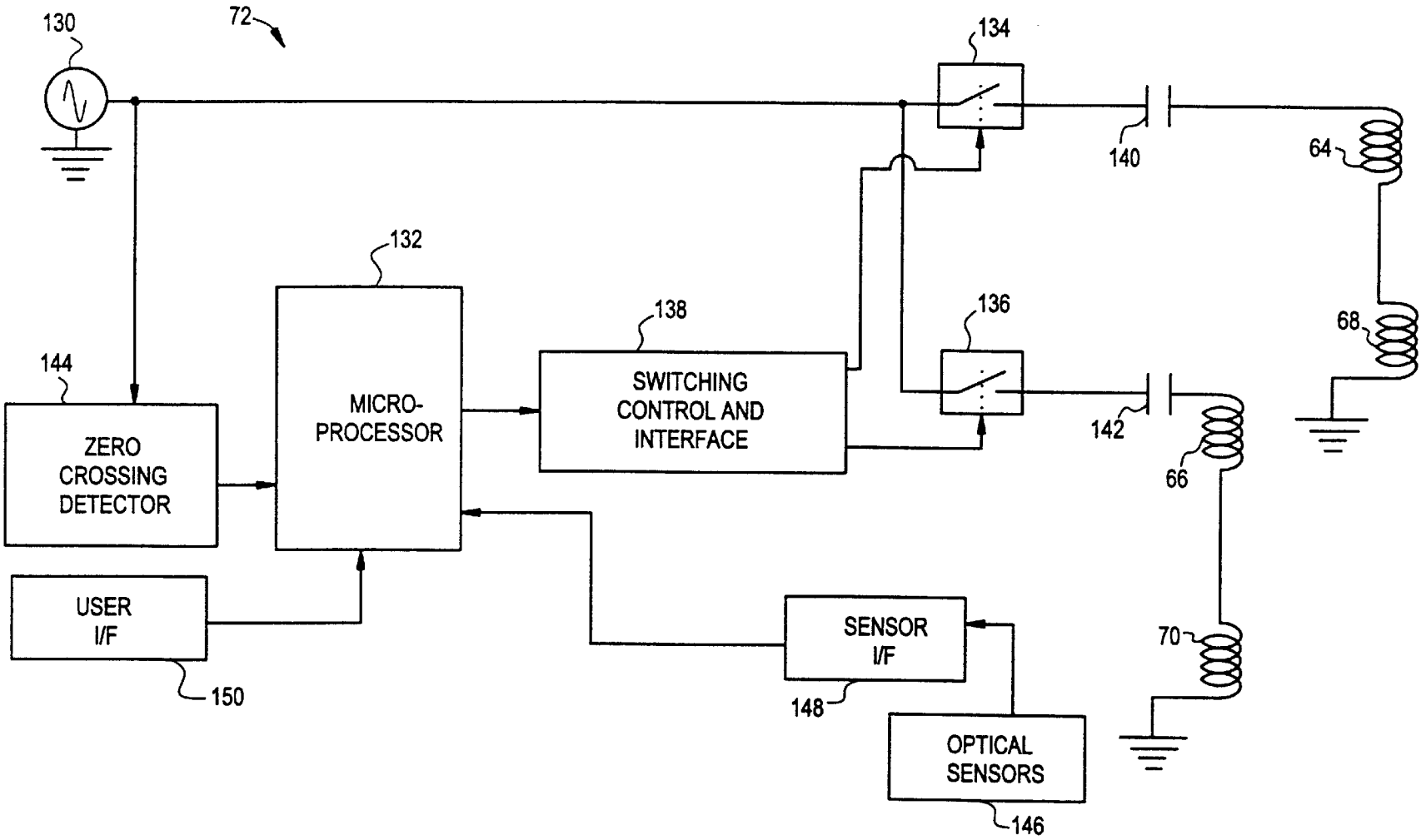
FIG. 10 shows additional details of the circuitry of FIG. 7.

Continuing to refer to FIG. 10, a user interface device 150 is connected to provide input signals to the microprocessor 132. The user interface device 150 allows a user to set operating parameters of the deactivation device. The operating parameters that are settable by the user may include (a) duty cycle of the driving signal applied to the coils, (b) peak amplitude (power level) of the driving signal applied to the coil, and/or (c) selection of motion-triggered operation versus continuous-wave operation.

In operation, a preferred embodiment of the deactivation device 50 is normally maintained in a dormant condition, with both switches 134 and 136 open, and no current flowing through coils 64, 68, 66 and 70, so that no deactivation field is provided, and power consumption is low. When motion is sensed by one or more of the optical sensors 146, a motion detection signal is provided to the microprocessor 132 through the sensor interface circuit 148. In response to the motion detection signal, the microprocessor 132 places the deactivation device 50 in an active condition for a predetermined limited period of time. The predetermined period of time may be on the order of 0.5 to 2.0 seconds, for example. While the deactivation device 50 is in the activated condition, it alternates between two modes of operation. In the first mode of operation, the switch 134 is closed and the switch 136 is opened, and the pair of coils 64 and 68 is energized. In the second mode of operation, switch 136 is closed and switch 134 is open, and the pair of coils 66 and 70 is energized.

Figure 11:
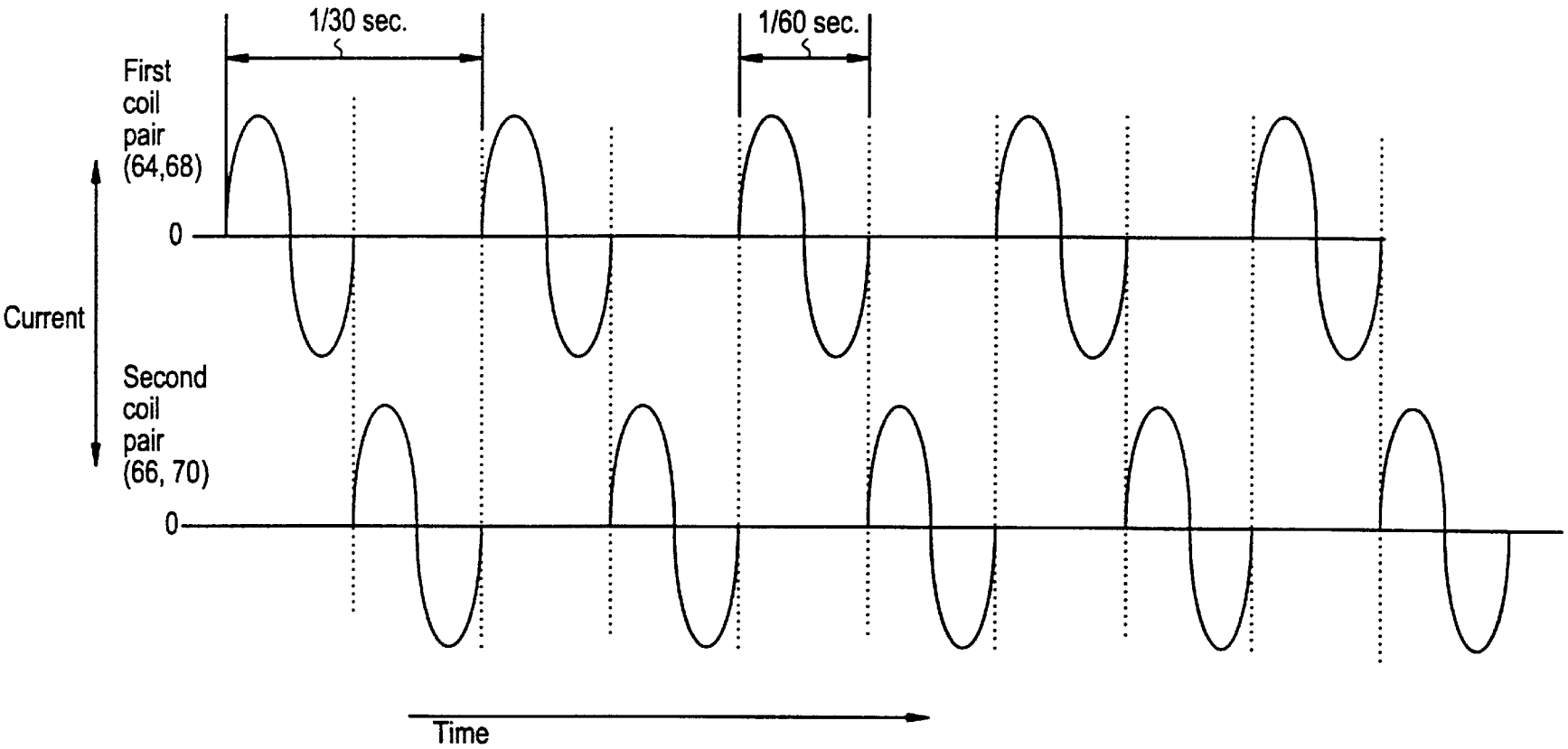
FIG. 11 is a waveform diagram which shows current drive cycles applied to pairs of coils in the circuitry of FIG. 10.

Operation of the deactivation device in a manner which alternates between the two operating modes is illustrated in FIG. 11. As seen from FIG. 11, each pair of coils is driven for one cycle of the power signal, then the other pair is driven for one cycle, and this sequence is repeated.

It will be understood, that in the resonant circuitry formed by each pair of coils and its respective capacitor, capacitor current and voltage are at a 90° phase offset. FIG. 11 indicates current wave forms of the signals by which the respective pairs of coils are energized. After one pair of coils has been driven for a single cycle of the drive signal, the mode of operation is switched, and the other pair of coils is then driven for one cycle. The mode change-over is accomplished by opening the switch which corresponds to the former pair of coils and substantially simultaneously closing the switch which corresponds to the latter pair of coils. The mode change-over occurs at a timing which corresponds with the peak voltage, and the zero current point in the cycle. Consequently, at the end of the cycle, current in the former pair of coils is at a zero point, and capacitor voltage is at a maximum. Because the switch is opened at a zero current point, the voltage in the corresponding capacitor is maintained, and there is no ring down during the period when the corresponding switch is open. It is assumed for the purposes of FIG. 11 that the input power signal is at 60 Hz, so that the period corresponding to each cycle of the drive signal is one-sixtieth of a second, and the interval at which the drive signal repeats in each of the coil pairs corresponds to 30 Hz.

It is also contemplated to apply the present invention in a deactivation device which employs two core-wound coils or two pairs of such coils without switching the apparatus between operating modes. Rather, each respective coil or coil pair may be driven with an alternating signal that is 90° out of phase with the driving signal for the other coil or coil pair. An apparatus of this kind may be operated continuously, and the driving signal for each respective coil or coil pair may be derived from an input power signal by very simple circuitry, such as a single capacitor for each coil or coil pair, to induce, respectively, a +45° and −45° phase shift in the input power signal. A deactivation device of this type, employing quadrature-driven coils or coil pairs and continually in operation, may have the energizing signal for the coils provided at a relatively low level suitable for deactivating markers applied to recording medium products such as pre-recorded magnetic tape cassettes. It is further contemplated that a deactivation device employing quadrature-driving coils or coil pairs may be operated intermittently, in response to motion sensing by optical sensors, or based on other input indicative of the presence of a marker to be deactivated.

Marker deactivation devices in which coils for generating the deactivation field are provided as windings around a magnetic core present a number of advantages relative to deactivation devices which employ air-core coils. As noted above, for a given size of dipole that is to be produced, the magnetic core based coil deactivation devices can be made smaller in size than air-core devices. Further, for a given field level to be achieved at a fixed excitation current, the quantity of copper wire to be used in the coil winding can be substantially reduced if a magnetic core is provided, thereby decreasing the cost of the device. The savings in copper wire outweigh the cost of providing the magnetic cores, since the magnetic cores may be formed of very inexpensive material. Also, with the reduction in the amount of copper wire, and excitation at lower current levels, the power loss in the copper wire is much less than in air-core coils, and this savings more than makes up for the minimal current losses in the core itself, since the core losses are low at the preferred operating frequencies. Consequently, the cost of operation of the device is reduced, and less expensive driving circuitry may be employed.

Although not shown in the drawings, it is contemplated to incorporate in the above-described deactivation devices a magnetic shield member to enhance the magnetic field provided above the device. The shield member would be disposed horizontally and below the coil-wound core or cores and may be formed of a laminated transformer sheet of pressed powdered iron, like the material disclosed in U.S. Pat. No. 4,769,631. The shield member should be displaced downwardly from the core by at least one inch to avoid undesirable diversion of the magnetic field from the space above the deactivation device.

It is intended to operate the deactivation devices disclosed herein in conjunction with either conventional magnetomechanical EAS markers, or with magnetomechanical markers which include a low-coercivity bias element of the type disclosed in co-pending application Ser. No. 08/697,629. One material suitable for use at such a low-coercivity bias element is designated as "MagnaDur 20-4" which is commercially available from Carpenter Technology Corporation, Reading, Pa., and has substantially the following composition: $Fe_{77.5}Ni_{19.3}Cr_{0.2}Mn_{0.3}Mo_{2.4}Si_{0.3}$ (atomic percent). Use of markers having the low-coercivity bias element permits operation of the deactivation devices with a relatively low-level deactivation field. The operating power level of the deactivation devices can be low, so that the deactivation device can be operated continuously. This makes it unnecessary to trigger operation of the deactivation devices when a marker is present. However, as indicated above, it is also contemplated to operate the deactivation device only on occasions when motion is sensed by optical sensors. Other techniques of intermittent operation, including operation in response to marker detection, are also within the contemplation of the invention.

In the following claims, it is to be understood that a coil should be considered "wound" around a corresponding core element whether the wire making up the core is wound directly around the core, or is pre-wound and then, after pre-winding, is slid onto the core.

Various changes in the foregoing apparatus and practices may be introduced without departing from the invention. The particularly preferred embodiments of the invention are thus intended in an illustrative and not limiting sense. The true spirit and scope of the invention is set forth in the following claims.

What is claimed is:

1. In a device for deactivating a magnetomechanical EAS marker, the device including a coil and means for energizing the coil to generate an alternating magnetic field, the improvement comprising a magnetic core around which the coil is wound, wherein said core is cruciform and has four arms, and a respective coil is positioned on each of said arms, and wherein said means for energizing includes means for energizing the respective coils on an opposed pair of said four arms, only during a first sequence of time intervals, and for energizing the respective coils on another opposed pair of said four arms, only during a second sequence of time intervals interleaved with said first sequence of time intervals.

2. The invention according to claim 1, wherein said core is formed of a material selected from the group consisting of powdered metal, cast iron, silicon steel and carbon steel.

3. In a device for deactivating a magnetomechanical EAS marker, the device including a coil and means for energizing the coil to generate an alternating magnetic field, the improvement comprising a magnetic core around which the coil is wound, wherein said core is generally square and planar, and has two coils wound thereon, said two coils having respective axes that are orthogonal to each other.

4. The invention according to claim 3, wherein the respective axes of the coils are parallel to the plane of the core.

5. The invention according to claim 3, wherein said means for energizing includes means for energizing a first one of the two coils, only during a first sequence of time intervals, and for energizing the other of the two coils, only during a second sequence of time intervals interleaved with said first sequence of time intervals.

6. The invention according to claim 3, wherein at least one of said coils is wound in a plurality of layers around said core, said layers including an innermost layer and another layer, said innermost layer being nearer to the core than said another layer, said innermost layer being formed of a larger number of turns than said another layer.

7. The invention according to claim 6, wherein said at least one of the coils is wound in three layers consisting of an innermost layer, an intermediate layer, and an outermost layer; said innermost layer being nearer to the core than said intermediate layer, said intermediate layer being nearer to the core than said outermost layer; said innermost layer being formed of a larger number of turns than said intermediate layer, said intermediate layer being formed of a larger number of turns than said outermost layer.

8. In a device for deactivating a magnetomechanical EAS marker, the device including a coil and means for energizing the coil to generate an alternating magnetic field, the improvement comprising a magnetic core around which the coil is wound, wherein said coil is wound in a plurality of layers around said core, said layers including an innermost layer and another layer, said innermost layer being nearer to the core than said another layer, said innermost layer being formed of a larger number of turns than said another layer.

9. Apparatus for deactivating a magnetomechanical marker, comprising:

a magnetic core;

at least two coils wound around said magnetic core;

first means for energizing a first one of said coils only during a first sequence of time internals and not during a second sequence of time intervals interleaved with said first sequence of time intervals; and second means for energizing a second one of said coils only during said second sequence of time intervals and not during said first sequence of time intervals.

10. Apparatus according to claim 9, wherein said first coil has an axis of winding that is perpendicular to an axis of winding of said second coil.

11. Apparatus according to claim 10, wherein said core is cruciform and has four arms, said at least two coils including four coils, each positioned on a respective one of said four arms of said core.

12. Apparatus according to claim 11, wherein, only during said first sequence of time intervals, said first means energizes two of said coils, which are respectively positioned on an opposed pair of said arms of said core; and, only during said second sequence of time intervals, said second means energizes the coils positioned on the other arms of said core.

13. Apparatus according to claim 10, wherein said core is generally square and planar; said first coil being wound around said core with an axis of said first coil parallel to the plane of said core, and said second coil being wound around said core with an axis of said second coil parallel to the plane of said core and perpendicular to the axis of said first coil.

14. Apparatus according to claim 10, wherein said at least two coils wound around said core include a first pair of coils energized by said first means only during said first sequence of time intervals and a second pair of coils energized by said second means only during said second sequence of time intervals.

15. Apparatus according to claim 14, wherein the coils of said first pair of coils have respective axes that are parallel to each other and the coils of said second pair of coils have respective axes that are parallel to each other and are perpendicular to the axes of the first pair of coils.

16. Apparatus according to claim 14, wherein the coils of said first pair of coils have a common axis, and the coils of said second pair of coils have a common axis that is perpendicular to the common axis of the first pair of coils.

17. A method according to claim 19, wherein said energizing step further includes energizing one of said coils only during a first sequence of time intervals and energizing another of said coils during a second sequence of time intervals interleaved with said first sequence of time intervals.

18. A method according to claim 17, wherein said providing step includes providing four coils wound around said core.

19. A method of deactivating a magnetomechanical EAS marker, comprising the steps of:

providing a coil wound around a magnetic core, said providing including providing two coils wound around said core;

energizing said coil to generate an alternating magnetic field, said energizing including inducing respective alternating currents in said two coils such that the alternating currents are substantially 90° out of phase with each other; and moving said EAS marker through said alternating magnetic field to degauss a control element of said marker.

20. A method of manufacturing a device for deactivating magnetomechanical EAS markers, comprising the steps of:

providing a magnetic core, said magnetic core being planar and square;

winding a first length of conductive wire on said core in a first direction to form a first coil; and winding a second length of conductive wire on said core in a second direction to form a second coil, said second direction being perpendicular to said first direction and said second coil being wound over said first coil.

21. A method according to claim 20, wherein said core is formed of a material selected from the group consisting of powdered metal, cast iron, silicon steel and carbon steel.

22. A method of deactivating a magnetomechanical electronic article surveillance marker, comprising the steps of:

providing a first coil wound on a core;

providing a second coil wound on said core;

first energizing said first coil only on a plurality of first occasions and not during a plurality of second occasions different from said first occasions to induce in said first coil an alternating current;

second energizing said second coil only on said plurality of second occasions and not on said plurality of first occasions to induce in said second coil an alternating current; and during a period of time that corresponds to at least one of said first occasions and at least one of said second occasions, sweeping said magnetomechanical marker in proximity to said coils to demagnetize a bias element included in said marker.

23. A method according to claim 22, wherein at least two of said first occasions and at least two of said second occasions take place within a period of one second.

24. Apparatus for deactivating an electronic article surveillance marker, comprising:

a magnetic core;

two coils wound around said magnetic core, said two coils comprising a first coil and a second coil; and drive means for energizing said coils, said drive means operating in a first mode in a first sequence of time intervals and in a second mode in a second sequence of time intervals interleaved with said first sequence of time intervals, said drive means driving said first coil with an alternating current in said first mode and not driving said second coil in said first mode, said drive means driving said second coil with an alternating current in said second mode and not driving said first coil in said second mode.

25. Apparatus according to claim 24, further comprising a housing in which said coils are housed.

26. Apparatus according to claim 25, wherein said drive means is housed in said housing.

27. Apparatus according to claim 24, wherein a plurality of said time intervals of said first sequence and a plurality of said time intervals of said second sequence take place within a period of one second.

28. A method of deactivating a magnetomechanical electronic article surveillance marker, comprising the steps of:

providing a first coil wound on a first core;

providing a second coil wound on a second core;

first energizing said first coil only on a plurality of first occasions and not during a plurality of second occasions different from said first occasions to induce in said first coil an alternating current;

second energizing said second coil only on a plurality of second occasions and not on said plurality of first occasions to induce in said second coil an alternating current; and during a period of time that corresponds to at lease one of said first occasions and at least one of said second occasions, sweeping said magnetomechanical marker in proximity to said coils to demagnetize a bias element included in said marker.

29. A method according to claim 28, wherein said plurality of first occasions and said plurality of second occasions take place within a period of one second.

30. Apparatus for deactivating an electronic article surveillance marker, comprising:

a first magnetic core;

a first coil wound around said first magnetic core;

a second magnetic core;

a second coil wound around said second magnetic core; and drive means for energizing said coils, said drive means operating in a first mode in a first sequence of time intervals and in a second mode in a second sequence of time intervals interleaved with said first sequence of time intervals, said drive means driving said first coil with an alternating current in said first mode and not driving said second coil in said first mode, said drive means driving said second coil with an alternating current in said second mode and not driving said first coil in said second mode.

31. Apparatus according to claim 30, further comprising a housing in which said coils are housed.

32. Apparatus according to claim 31, wherein said drive means is housed in said housing.

33. Apparatus according to claim 30, wherein a plurality of said time intervals of said first sequence and a plurality of said time intervals of said second sequence take place within a period of one second.

34. Apparatus for deactivating an electronic article surveillance marker, comprising:

a magnetic core;

two coils wound around said magnetic core; and drive means for energizing said coils, said drive means inducing respective alternating currents in said two coils such that the alternating currents are substantially 90° out of phase with each other.

35. Apparatus for deactivating an electronic article surveillance marker, comprising:

a first magnetic core;

a first coil wound around said first magnetic core;

a second magnetic core;

a second coil wound around said second magnetic core; and drive means for energizing said coils, said drive means inducing respective alternating currents in said first and second coils such that the alternating currents are substantially 90° out of phase with each other.

* * * * *